United States Patent [19]

Kaplan

[11] Patent Number: 4,725,756

[45] Date of Patent: Feb. 16, 1988

[54] TENSION MASK COLOR CATHODE RAY TUBE FRONT ASSEMBLY HAVING A STABILIZED MASK SUPPORT FRAME

[75] Inventor: Sam H. Kaplan, Chicago, Ill.

[73] Assignee: Zenith Electronics Corporation, Glenview, Ill.

[21] Appl. No.: 835,845

[22] Filed: Mar. 3, 1986

[51] Int. Cl.[4] ..... H01J 29/07; H01J 29/82

[52] U.S. Cl. ..... 313/407; 313/408; 313/482

[58] Field of Search ..... 313/402, 407, 408, 482

[56] References Cited

U.S. PATENT DOCUMENTS

| | | | |
|---|---|---|---|
| 2,625,734 | 1/1953 | Law | 29/25.13 |
| 2,842,696 | 7/1958 | Fischer-Colbrie | 313/78 |
| 2,905,845 | 9/1959 | Vincent | 313/78 |
| 3,030,536 | 4/1956 | Hackett et al. | 313/80 |
| 3,284,655 | 11/1966 | Oess | 313/286 |
| 3,727,087 | 4/1973 | Steinberg et al. | 313/91 |
| 3,735,179 | 5/1973 | Kaplan | 313/402 |
| 3,894,321 | 7/1975 | Moore | 29/25.15 |
| 4,045,701 | 8/1977 | Dougherty | 313/402 |
| 4,100,451 | 7/1978 | Palac | 313/404 |
| 4,547,696 | 10/1985 | Strauss | 313/407 |

OTHER PUBLICATIONS

Journal Article, "The CBS Colortron: A Color Picture Tube of Advanced Design", Fyler et al., Proc. of the Ire, Jan. 1954.

Tektronix, Inc. spec sheet: "Avionics Color Cathode Ray Tube", TEK T8100.

Tektronix Journal Article: "A High Brightness Shadow Mask Color CRT for Cockpit Displays," Society for Information Display, Philadelphia, May, 1983.

*Primary Examiner*—David K. Moore

*Assistant Examiner*—K. Wieder

*Attorney, Agent, or Firm*—Ralph E. Clarke, Jr.

[57] ABSTRACT

A front assembly for a color cathode ray tube is disclosed. The tube includes a faceplate having on its inner surface a centrally disposed phosphor screen. A shadow mask support structure is resting on and secured to the inner surface of the faceplate on opposed sides of the screen. A foil shadow mask is secured to the structure under high inward tension. The shadow mask support structure according to the invention is characterized by having at least one foot resting on the inner surface for bracing and stabilizing the structure against upset from the high tension of the mask. Other embodiments of the invention are shown in which one or more of the feet have a plurality of open-ended or closed-ended openings therein for facilitating passage of the cement used for attaching the support structure to the inner surface of the faceplate. The openings according to the invention present cement-contactible edges for enhancing the securement of the support structure.

18 Claims, 14 Drawing Figures

TENSION MASK COLOR CATHODE RAY TUBE FRONT ASSEMBLY HAVING A STABILIZED MASK SUPPORT FRAME

CROSS-REFERENCE TO RELATED APPLICATIONS

This application is related to but in no way dependent upon copending applications Ser. No. 538,001 filed Sept. 30, 1983; Ser. No. 538,003 filed Sept. 30, 1983; Ser. No. 572,088, filed Jan. 18, 1984, now U.S. Pat. No. 4,547,696; Ser. No. 572,089, filed Jan. 18, 1984; Ser. No. 725,040, filed Apr. 19, 1985; Ser. No. 729,015; filed May 17, 1985; Ser. No. 758,174, filed July 23, 1985; Ser. No. 832,559, filed Feb. 21, 1986; Ser. No. 832,493 filed Feb. 21, 1986; Ser. No. 832,556, filed Feb. 21, 1986, and Ser. No. 831,699, filed Feb. 21, 1986, all of common ownership herewith.

BACKGROUND OF THE INVENTION

This invention relates generally to color cathode ray picture tubes and is addressed particularly to an improved front assembly component for color tubes that have a tension foil shadow mask. The invention is applicable to tension mask tubes of various types including those intended for home entertainment television receivers and for medium-resolution and high-resolution tubes for color monitors.

A color cathode ray tube typically has three electron guns arranged in an in-line configuration. Each gun projects an electron beam through the apertures of a "shadow mask" onto assigned target areas located on the inner surface of the faceplate. The target areas comprise patterns of phosphor deposits typically arranged in triads of dots or lines. Each of the triads consists of a deposit of a red-light-emitting, green-light-emitting, and blue-light-emitting phosphor which are excited to luminescence under bombardment by the respective electron beams. To increase the apparent brightness of the display, and to minimize the incidence of color impurities that can result if a beam falls upon an unassigned phosphor deposit, the target area may include a layer of light-absorbing material termed a "grille" that surrounds each of the phosphor deposits.

The front assembly of a color cathode ray tube essentially comprises the faceplate with its deposits of the grille dag and the light-emitting phosphors, a shadow mask, and a support structure for the mask. As is well known in the art, the shadow mask is precisely spaced from the inner surface of the faceplate. The shadow mask acts as a color-selection electrode, or parallax barrier, that ensures that each of the three beams lands only on its assigned phosphor deposits.

This invention is concerned with a tension foil shadow mask that comprises an apertured metallic foil which may, by way of example, be about one mil or less in thickness. This type of mask must be supported in high tension a predetermined distance from the inner surface of the cathode ray tube faceplate—a distance known as the "Q-distance". The mask tension for a 14-inch tension mask cathode ray tube may be in the range of 20 to 40 kpsi, by way of example.

The physical requirements for the tension foil shadow mask support structure are stringent. As the shadow mask is mounted under high tension, the structure must be of high strength so that the mask is held immovable—an inward movement of the mask of as little as one-tenth of a mil can result in loss of guard band and consequent color impurities. Also, the mask support structure must be of such configuration and material composition as to be compatible with the means to which it is secured. For example, if the mask support structure is attached to glass such as the glass of the inner surface of the faceplate, it is essential that the material from which the structure is made have about the same thermal coefficient of expansion as that of the glass so the glass will not crack as a result of thermal stress. Also, the mask support structure must be of such composition that the mask can be securely fastened to it by means such as electrical resistance welding, by way of example. It is also preferable that the surface to which the mask is secured be of such flatness that no voids between the metal of the mask and the surface can exist to prevent the intimate metal-to-metal contact required for positive welding.

Prior art includes: Moore—U.S. Pat. No. 3,894,321; Strauss—U.S. Pat. No. 4,547,696; Palac—U.S. Pat. No. 4,100,451; Dougherty—U.S. Pat. No. 4,045,701; Steinberg et al—U.S. Pat. No. 3,727,087; Oess—U.S. Pat. No. 3,284,655; Hackett et al—U.S. Pat. No. 3,030,536; Vincent—U.S. Pat. No. 2,905,845; Fischer-Colbrie—U.S. Pat. No. 2,842,696; Law—U.S. Pat. No. 2,625,734; also, an article titled "The CBS Colortron: A color picture tube of advanced design." Fyler, et al. Proc. of the IRE, Jan. 1954; and a Tektronix, Incorporated specification sheet: "Avionics Color Cathode Ray Tube," TEK T8100; also a digest of a Tektronix journal article: "A High Brightness Shadow-Mask Color CRT for Cockpit Displays," Society for Information Display, Philadelphia. May 1983.

OBJECTS OF THE INVENTION

It is a general object of the invention to provide an improved front assembly for tension foil shadow mask tubes.

It is another general object of the invention to provide enhanced quality and reliability in color cathode ray tubes that utilize the tension foil shadow mask.

It is an object of the invention to provide a tension foil shadow mask support structure that can be mounted on a flat faceplate for receiving a tension foil shadow mask.

It is an object of the invention to provide a tension foil shadow mask structure that is capable of holding a highly tensed foil shadow mask precisely in registration under high electron beam bombardment.

It is a further object of the invention to provide a tension foil shadow mask support structure stabilized and braced for maximum resistance to lateral displacement stemming from high mask tension.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

Figure 1:
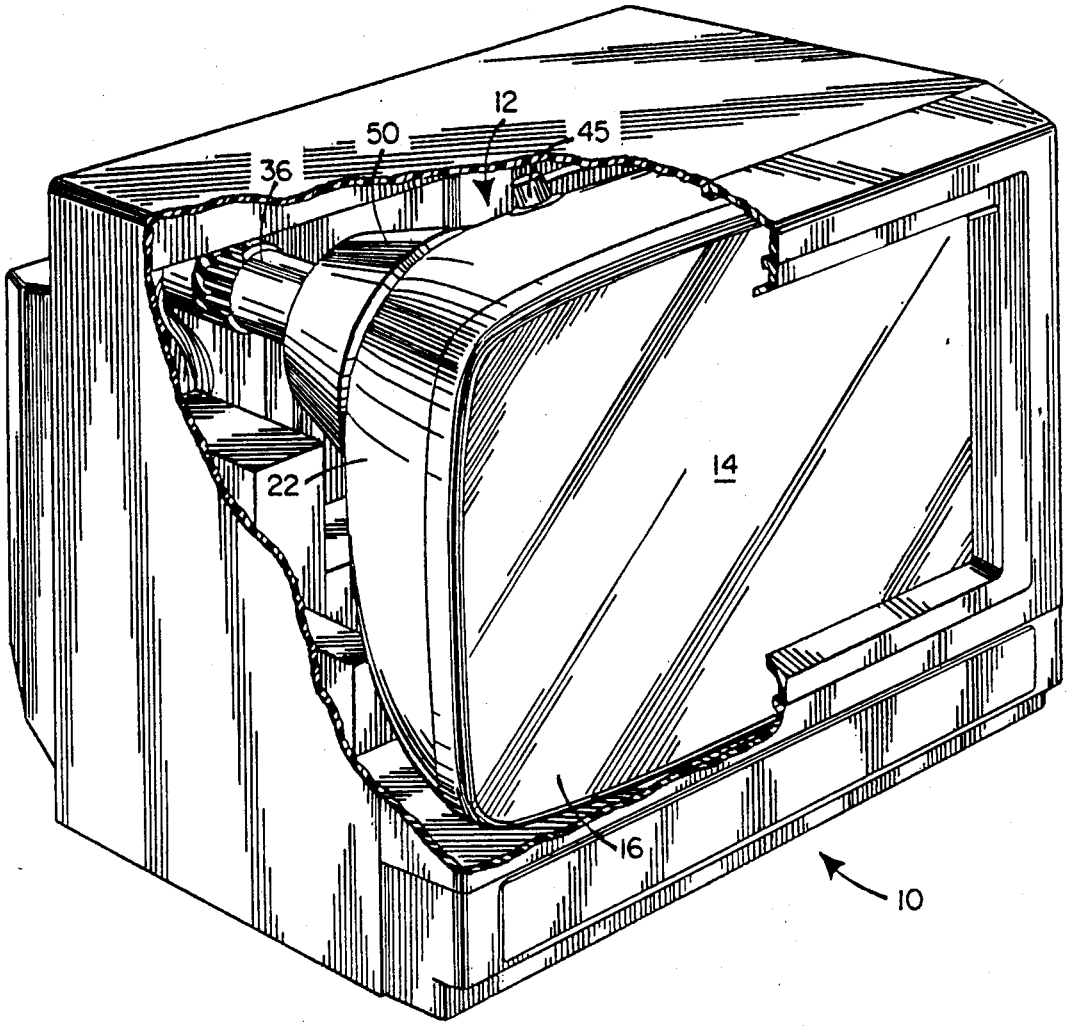
FIG. 1 is a cut-away view in perspective of a cabinet that houses a color cathode ray tube which incorporates a shadow mask support structure according to the invention; major tube components relevant to the disclosure are depicted.
Figure 2:
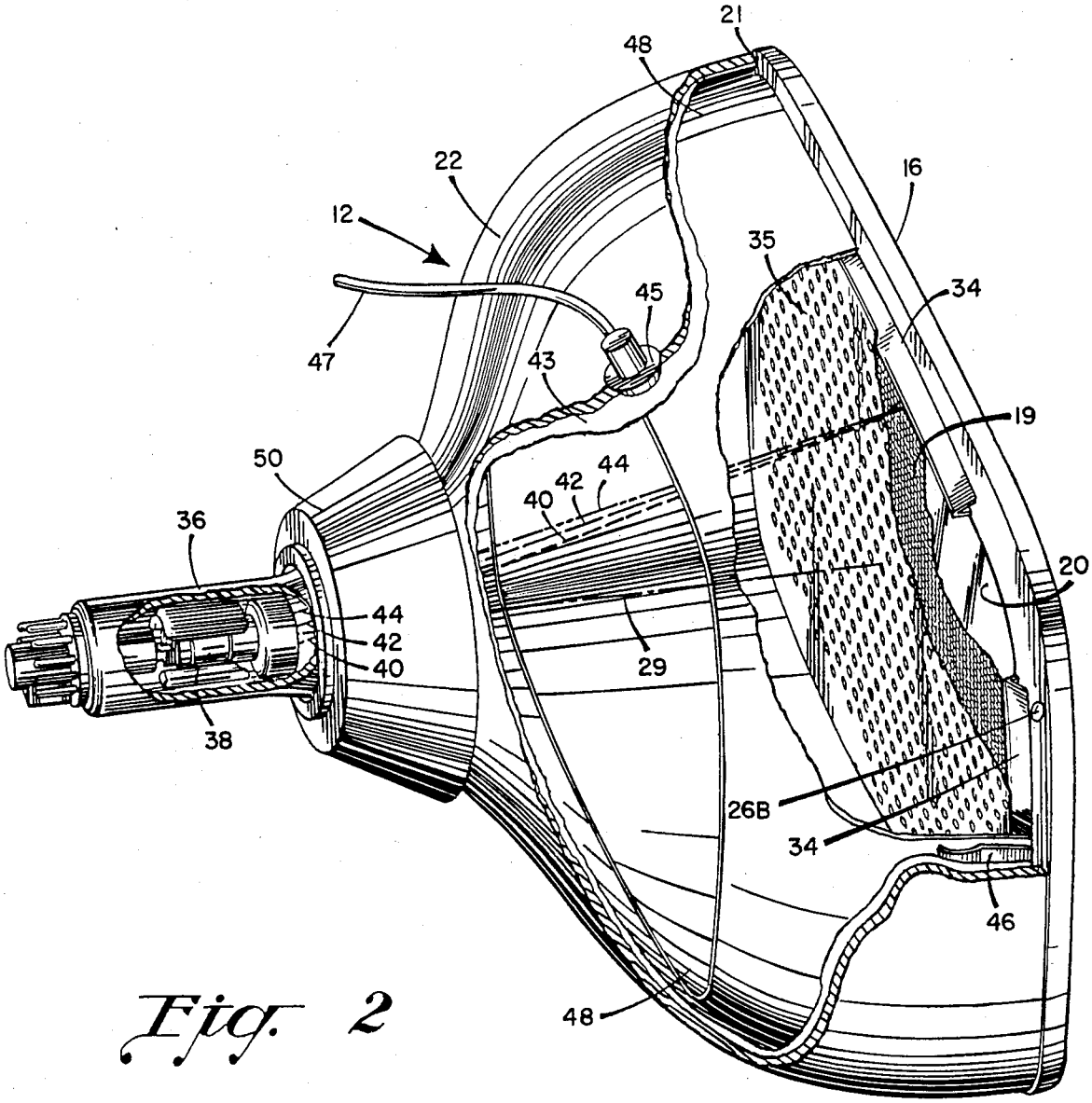
FIG. 2 is a side view in perspective of the color cathode ray tube of FIG. 1 showing another view of components depicted in FIG. 1, together with cut-away sections that indicate the location and relation of the stabilized shadow mask support structure according to the invention.
Figure 2A:
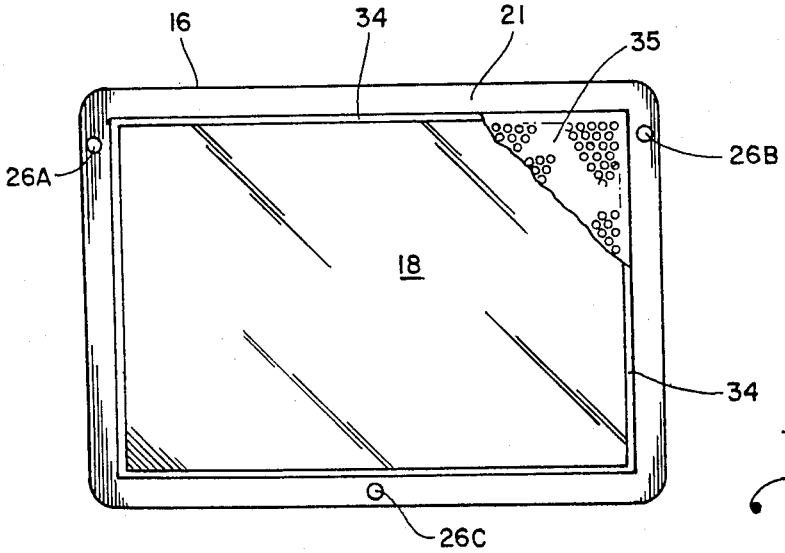
FIG. 2A is a plan view showing the relationship of the shadow mask support structure according to the invention to the faceplate.
Figure 3:
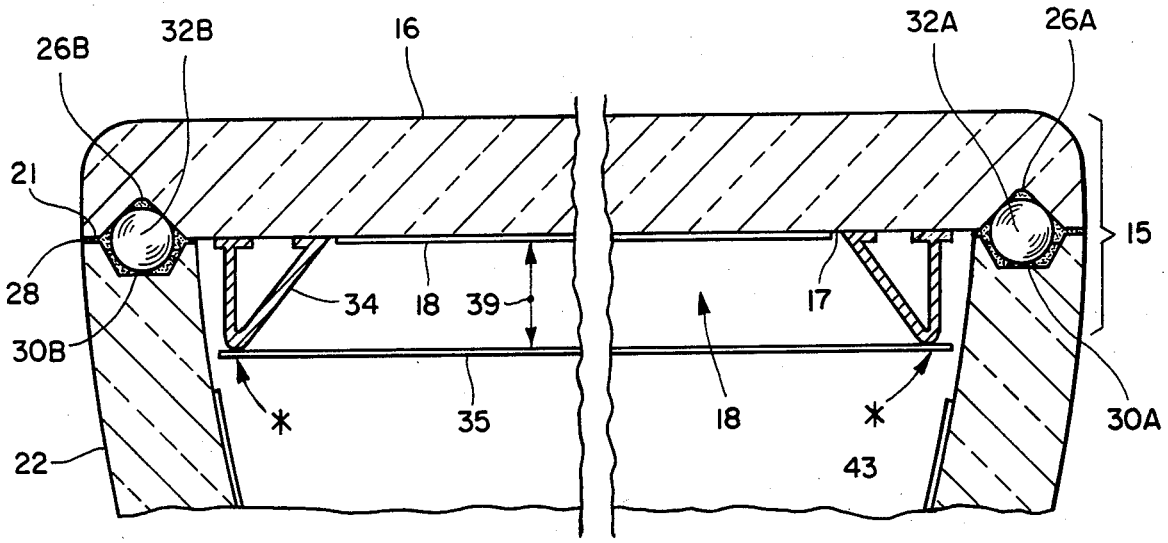
FIG. 3 is a view in elevation of a conjoined faceplate and a funnel sectioned at a 120-degree azimuthal interval, and showing in greater detail the stabilized shadow mask support structure according to the invention following its installation in a cathode ray tube.

FIG. 1 depicts a video monitor 10 that houses a color cathode ray tube 12. The design of the video monitor is the subject of copending design patent application Ser. No. 725,040 of common ownership herewith. The monitor-associated tube 12 is notable for the relatively flat imaging area 14 that makes possible the display of images in undistorted form. Imaging area 14 also offers a more efficient use of screen area as the corners are relatively square in comparison with the more rounded corners of the conventional cathode ray tube. With reference also to FIGS. 2, 2A and 3, a front assembly 15 for a color cathode ray tube is depicted, the general scope of which is indicated by the bracket in FIG. 3. The front assembly 15 includes a glass faceplate 16 noted as being flat, or alternately, "substantially" flat in that it may have large but finite horizontal and vertical radii. Faceplate 16, depicted as being planar and flangeless, is represented as having on its inner surface 17 a centrally disposed phosphor screen 18. Screen 18 comprises materials screened thereon including deposits of light-emitting phosphors 19 overlaid with a very thin film of aluminum 20.

Screen 18 is surrounded by a peripheral sealing area 21 adapted to be mated with a funnel 22. Sealing area 21 is represented as having three indexing cavities 26A, 26B, and 26C therein. The cavities are preferably peripherally located equiangularly about the faceplate 16; that is, e.g., at 120-degree intervals, as indicated by FIG. 2A. The cavities provide for registering, in conjunction with complementary indexing means, faceplate 16 with funnel 22, as will be described.

Funnel 22 has a funnel sealing area 28 with indexing elements 30A, 30B and 30C therein in facing adjacency with indexing cavities 26A, 26B and 26C. Indexing elements 30A, 30B and 30C are in the form of V-grooves, preferably radially oriented with respect to the anterior-posterior axis 29 of tube 12. Ball means 32A, 32B and 32C are conjugate with the cavities 26A, 26B and 26C and V-grooves 30A, 30B and 30C for registering the faceplate 16 and the funnel 22. The indexing means are also utilized for the precision registration of the shadow mask with the faceplate during the photoscreening of the process materials on the faceplate. Reference numeral 29 indicates the anterior-posterior axis of tube 12.

Front assembly 15 includes a shadow mask support structure 34 according to the invention resting on and secured to the inner surface of faceplate 16 on opposed sides of screen 18 in the peripheral sealing area 21 of faceplate 16, and enclosing the screen 18. The configuration of support structure 34 as depicted is an aspect of the preferred embodiment of the invention, as will be described. Support structure 34 provides for supporting a welded-on tension foil shadow mask 35 a predetermined distance—the "Q" distance 39 indicated in FIG. 3—from the inner surface of faceplate 16. The welding indicated by the associated weldment symbols may be electrical resistance welding. Support structure 34 may for example be secured to the inner surface 17 of faceplate 16 by a devitrifying glass frit as is well-known in the art, or by a cold-setting cement such as a Sauereisen-type cement manufactured by Sauereisen Cements Company of Pittsburgh, Pa. The concept of a separate faceplate-mounted metal frame and a welded-on tension foil shadow mask is not the subject of the present invention, but is fully described and claimed in referent copending application Ser. No. 832,493 of common ownership herewith.

A neck 36 extending from funnel 22 is represented as housing an electron gun 38 which is indicated as emitting three electron beams 40, 42 and 44 that selectively excite the screen 18 on which is deposited the electron-beam-excitable, colored-light-emitting deposits of phosphors 19, noted as being overlayed with an aluminum film 20. Beams 40, 42 and 44 serve to selectively excite to luminescence the pattern of phosphor deposits 19 after passing through the parallax barrier formed by shadow mask 35 and through the aluminum film.

Funnel 22 is indicated as having an internal electrically conductive funnel coating 43 adapted to receive a high electrical potential. The potential is depicted as being applied through an anode button 45 to which is attached a conductor 47 which conducts the potential to the anode button 45 through the wall of the funnel 22. The source of the potential is a high-voltage power supply (not shown). The potential may be for example in the range of 18 to 26 kilovolts in the illustrated monitor application. Means for providing an electrical connection between the electrically conductive metal mask support structure 34 and the funnel coating 43 may comprise spring means 46.

A magnetically permeable internal magnetic shield 48 is shown as being attached to mask support structure 34. A yoke 50 is shown as encircling tube 12 in the region of the junction between funnel 22 and neck 36. Yoke 50 provides for the electromagnetic scanning of beams 40, 42 and 44 across the screen 18.

Figure 4:
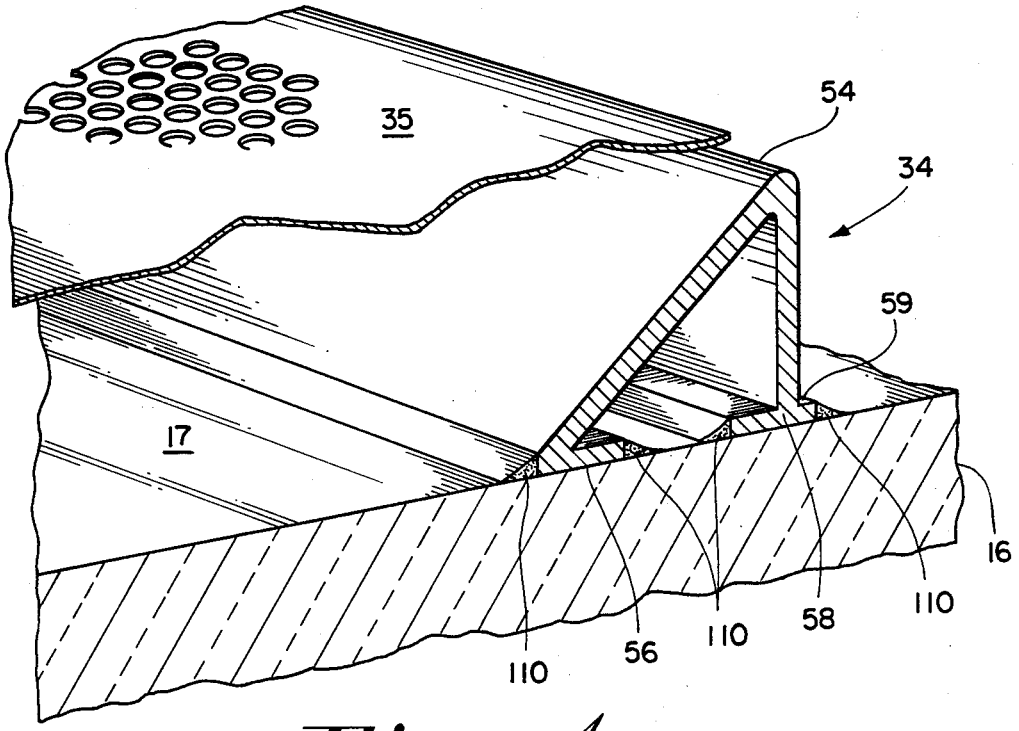
FIG. 4 is an oblique view in perspective and partly in section of a stabilized shadow mask support structure according to the invention with a shadow mask mounted thereon.

Mask support structure 34 according to the invention is shown in greater detail in FIG. 4. Structure 34 is depicted as having a surface 54 comprising a peak for receiving and securing foil shadow mask 35 under high inward tension; that is, tension toward the center of the faceplate. Mask support structure 34 according to the invention is characterized by having at least one foot. This embodiment is depicted as having two feet 56 and 58, resting on inner surface 17 of faceplate 16. The purpose of each foot is to brace and stabilize shadow mask support structure 34 against upset from the high tension of mask 35. Both foot 56 and foot 58 will be noted as turning inwardly. (In this application, the direction in which the foot or feet is said in turn is with respect to the support structure itself.) Foot 58 is also depicted as having a substantial heel 59.

Figure 5:
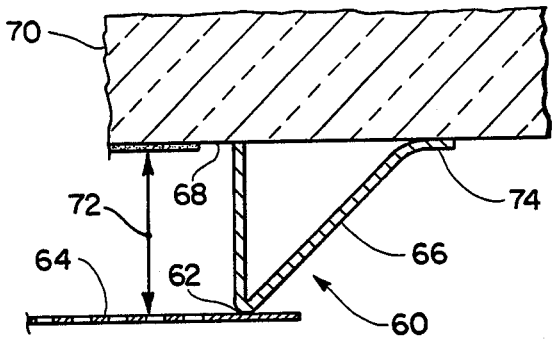
FIGS. 5–8 are sectional views in elevation showing other configurative aspects of the preferred embodiment of the invention.

An embodiment of the invention wherein a support structure has but one foot is shown by FIG. 5. Support structure 60 is depicted as having a first surface 62 comprising a peak for receiving and securing a foil shadow mask 64 under high inward tension. Support structure 60 is represented as having a second surface 66 extending radially outwardly. First surface 62 precisely defines a predetermined mask-to-screen Q-distance 72. Support structure 60 is characterized by the termination of the second surface 66 having a foot 74 resting on and secured to inner surface 68 and turning outwardly for bracing and stabilizing structure 34 against inward upset from the high tension of mask 64.

Figure 6:
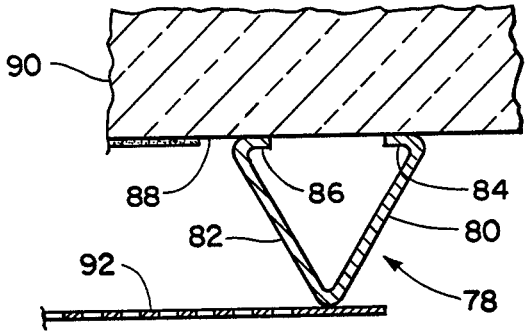

Another aspect of the preferred embodiment is depicted in FIG. 6 wherein there is depicted a support structure 78 composed of sheet metal and having two legs 80 and 82 with respective feet 84 and 86 turning inwardly and resting on the inner surface 88 of the faceplate 90 for bracing and stabilizing support structure 78 against inward upset by the high tension of the associated shadow mask 92.

Figure 7:
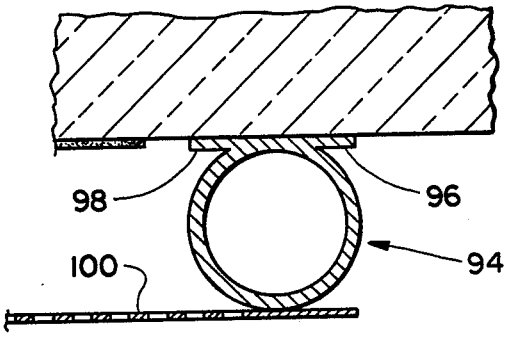
Figure 8:
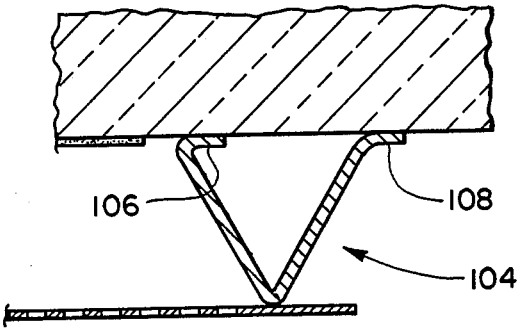

Another aspect of the preferred embodiment of the invention is depicted in FIG. 7 wherein there is represented a shadow mask support structure 94 having two feet 96 and 98 both of which turn outwardly for supporting a shadow mask 100 in high tension. Alternately, as shown by FIG. 8, a shadow mask support structure 104 according to the invention has two feet 106 and 108, with foot 106 represented as turning inwardly, and foot 108 as turning outwardly.

The shadow mask support structure according to the invention depicted by FIG. 4 is represented as being secured to the inner surface 17 of the faceplate 16 by fillets of cement 110, which may comprise, by way of example, a devitrifying frit. The embodiments of the invention shown by FIGS. 5–8 may also be so secured.

Figure 9:
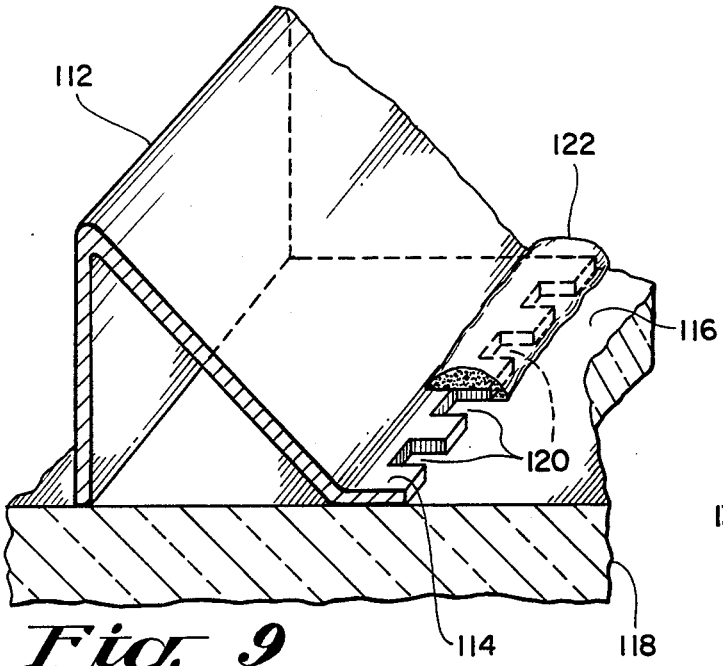
FIG. 9 is a view in perspective of a section of a shadow mask support structure showing another configurative aspect of the preferred embodiment of the invention.

Another aspect of the preferred embodiment is depicted in FIG. 9 wherein there is shown a shadow mask support structure 112 similar to the support structure 66 shown by FIG. 5 in that the support structure has a single foot 114. Shadow mask support structure 112 is secured by cement to the inner surface 116 of a faceplate 118. Foot 114 is represented as having a plurality of open-ended openings 120 therein. Openings 120 facilitate according to the invention the passage of cement 122 through the foot 114, by presenting cement-contactible edges for enhancing the securement of structure 112 to the inner surface 116 of faceplate 118. The open-ended openings 120 in this embodiment of the invention are shown as comprising a series of opposing notches indicated as being rectangular. The edges of the notches could as well be rounded.

Figure 10:
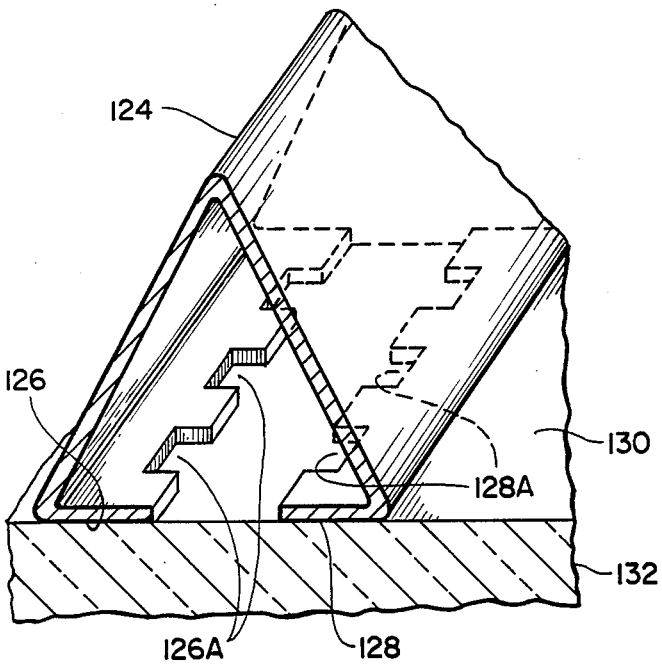
FIG. 10 is a perspective view of a section of a shadow mask support structure according to the invention showing yet another aspect of the configuration of a shadow mask support structure.

Another embodiment of the invention is shown by FIG. 10 wherein a shadow mask support structure 124 is characterized by having two facing feet 126 and 128 resting on the inner surface 130 of a faceplate 132. Foot 126 and foot 128 are indicated as having a plurality of respective open-ended openings 126A and 128A therein in the form of notches for facilitating the passage of cement through the feet, and presenting cement-contactible edges for enhancing the securement of structure 124 to the inner surface 130 of faceplate 132. (The flow of the cement as indicated by cement 122 in FIG. 9 is applicable as well to the structure of FIG. 10, and to the feet of the support structures described infra and depicted in FIGS. 11–13.)

Figure 11:
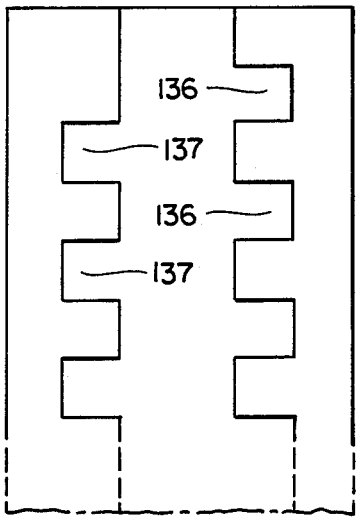
FIGS. 11–13 are plan views of further aspects of the shadow mask support structure foot configuration according to the invention.
Figure 12:
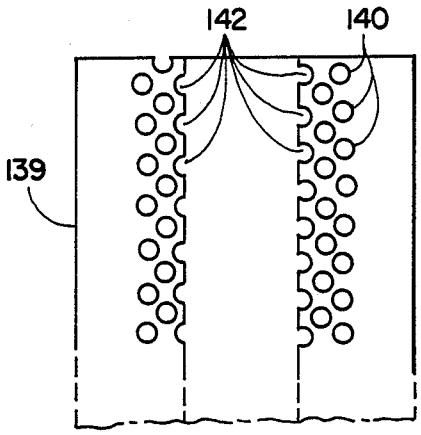

The open-ended openings 126A and 128A in the respective feet 126 and 128 are depicted in FIG. 10 as being in the form of a series of opposing notches. As depicted in FIG. 11, the open-ended openings in the feet 126 and 128 of support structure 124 according to the invention could as well comprise notches, or openings 136 and 137, staggered with respect to each other, as depicted. Alternately, as represented by FIG. 12, the openings in the foot 139 of a support structure could as well comprise closed-end openings comprising a series of apertures 140. The configuration shown by FIG. 12 is unique in that some of the apertures, i.e., apertures 142, comprise "open-ended" openings. This aspect of the invention is considered beneficial in that the open-ended openings 142 act as "claws" to grip the cement used to secure the foot according to the invention to the inner surface of the faceplate.

Figure 13:
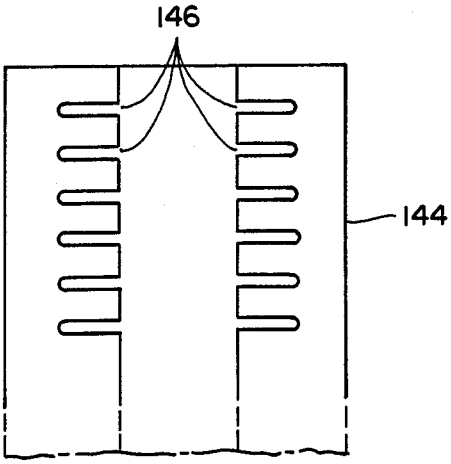

Another configuration of the preferred embodiment is shown by FIG. 13 wherein open-ended openings of the foot 144 of a support structure are shown as comprising narrow slits 146.

The benefits of the openings in the feet of a shadow mask support structure are two-fold: First, the presence of the open-ended or closed-end openings according to the invention facilitate conformance of the feet to the inner surface of the faceplate to which they are attached; that is, if the inner surface is not truly planar, the feet can flex to adapt to the untrue contour. Secondly, the securement of the shadow mask support structure to the inner surface of the faceplate is greatly enhanced because of the presentation of cement-contactible edges to the cement used to secure the structure to the inner surface of the faceplate.

The various configurations of the shadow mask support structures according to the invention can be fabricated by the roll-forming process well known in the art. Roll forming is a continuous high-production process for shaping metal strips by means of progressive forming rolls. The process is notable for accuracy in formation and production economy. Alternately, the shadow mask support structures according to the invention may be formed by cold extruding, also known as impact extruding or cold forging. As with roll forming, cold extruding provides close tolerances and excellent surface finishes. Both processes lend themselves to high-volume production. With regard to the roll-forming process, the notches or apertures in the feet can be die-cut or otherwise punched into the flat blanks prior to the forming operation.

The mask support structures are depicted as being hollow and are preferably formed from sheet metal. The structures could in some cases be composed of solid metal. With regard to the composition of the mask support structure 34 and the other support structures depicted, alloy No. 27 supplied by Carpenter Technology, Inc. of Reading, Pa. is preferred because its coefficient of thermal expansion is compatible with the glass of the faceplate. The cement for fastening the feet of the support structures is preferably a devitrifying glass frit well-known in the art. Alternately, as has been noted, a cold-setting cement can be employed, such as one of the cements supplied by Sauereisen Cements Co., of Pittsburgh, Pa.

As has been noted, the process of securing shadow mask to a frame, such as the frame 34 shown by FIG. 3, may be by electrical resistance welding. Laser welding is also a viable alternative. For a tube having a diagonal measure of 14 inches, as many as a thousand such welds at intervals of about 0.040 inch are recommended to ensure positive securement of the mask to the frame.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

I claim:

1. A front assembly for a color cathode ray tube including a faceplate having a flat inner surface and a flat outer surface, and having on its inner surface a centrally disposed phosphor screen, said assembly including a shadow mask support structure resting on and secured to said inner surface on opposed sides of said screen, and a foil shadow mask secured on said structure under high inward tension, said support structure being characterized by having at least one foot resting on said inner surface and extending in a direction substantially parallel with said inner surface and said screen for bracing and stabilizing said structure against upset from said high tension of said mask.

2. The front assembly according to claim 1 wherein said foot is turned inwardly.

3. The front assembly according to claim 1 wherein said foot is turned outwardly.

4. The front assembly according to claim 1 wherein said foot has a substantial heel.

5. A front assembly for a color cathode ray tube including a faceplate having a flat inner surface and a flat outer surface, and having on its inner surface a centrally disposed phosphor screen, said assembly including a shadow mask support structure composed of sheet metal located on opposed sides of said screen for receiving and securing a foil shadow mask in high tension, said structure having at least one leg with a foot resting on and secured to said inner surface and extending from said leg in a direction substantially parallel with said inner surface and said screen for bracing and stabilizing said support structure against inward upset by said high tension of said mask.

6. A front assembly for a color cathode ray tube including a faceplate having a flat inner surface and a flat outer surface, and having on its inner surface a centrally disposed phosphor screen, said assembly including a shadow mask support structure composed of sheet metal located on opposed sides of said screen for receiving and securing a foil shadow mask in high tension, said structure having two legs each with a foot resting on and secured to said inner surface and extending in a direction substantially parallel with said inner surface and said screen for bracing and stabilizing said support structure against inward upset by said high tension of said mask.

7. A front assembly for a color cathode ray tube including a faceplate having a flat inner surface and a flat outer surface, and having on its inner surface a centrally disposed phosphor screen, said assembly including a shadow mask support structure resting on and secured to said inner surface on opposed sides of said screen, said support structure having a first surface for receiving and securing a foil shadow mask under high inward tension, and a second surface extending radially outwardly such that said first surface precisely defines a predetermined mask-to-screen Q-distance, said support structure being characterized by the termination of said second surface having a foot secured to said inner surface and extending in a direction substantially parallel with said inner surface and said screen for bracing and stabilizing said structure against inward upset from said high tension of said mask.

8. A front assembly for a color cathode ray tube including a faceplate having a flat inner surface and a flat outer surface, and having on its inner surface a centrally disposed phosphor screen, said assembly including a shadow mask support structure composed of sheet metal located on opposed sides of said screen for receiving and securing a foil shadow mask in high tension, said structure having two feet extending in a direction substantially parallel with said inner surface and said screen for bracing and stabilizing said support structure against inward upset by said high tension of said mask.

9. The front assembly according to claim 8 wherein one of said feet turns inwardly and the other turns outwardly.

10. The front assembly according to claim 8 wherein both of said feet turn inwardly.

11. The front assembly according to claim 8 wherein both of said feet turn outwardly.

12. A front assembly for a color cathode ray tube including a faceplate having a flat inner surface and a flat outer surface, and having on its inner surface a centrally disposed phosphor screen, said assembly including a shadow mask support structure secured by cement to said inner surface on opposed sides of said screen, and a foil shadow mask secured to said structure under high inward tension, said support structure having at least one foot extending in a direction substantially parallel with said inner surface and said screen, said foot having a plurality of open-ended or closed-ended openings therein, said openings facilitating passage of said cement through the foot and presenting cement-contactible edges for enhancing the securement of said structure to said inner surface.

13. The front assembly according to claim 12 wherein said closed-ended openings comprise a pattern of apertures.

14. The front assembly according to claim 12 wherein said open-ended openings comprise a series of notches.

15. A front assembly for a color cathode ray tube including a faceplate having a flat inner surface and a flat outer surface, and having on its inner surface a centrally disposed phosphor screen, said assembly including a shadow mask support structure secured by cement to said inner surface on opposed sides of said screen, and a foil shadow mask secured to said structure under high inward tension, said support structure being characterized by having two facing feet resting on said inner surface and extending outwardly in a direction substantially parallel with said inner surface and said screen, said feet having a plurality of open-ended or closed-ended openings therein, said openings facilitating passage of said cement through the feet and presenting cement-contactible edges for enhancing the securement of said structure to said inner surface.

16. The front assembly according to claim 15 wherein said open-ended openings are in the form of a series of opposing notches.

17. The front assembly according to claim 15 wherein said open-ended openings are in the form of a series of opposing notches staggered with respect to each other.

18. The front assembly according to claim 15 wherein said open-ended openings comprise a series of apertures.

* * * * *